US006511204B2

(12) United States Patent
Emmel et al.

(10) Patent No.: US 6,511,204 B2
(45) **Date of Patent: *Jan. 28, 2003**

(54) LIGHT TUBE

(75) Inventors: John J. Emmel, Blaine, MN (US); Daniel A. Japuntich, St. Paul, MN (US); Lynette M. Miles, Lakeville, MN (US); James E. Nash, Bloomington, MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/464,565

(22) Filed: Dec. 16, 1999

(65) Prior Publication Data

US 2002/0101733 A1 Aug. 1, 2002

(51) Int. Cl.[7] ..... F21S 4/00
(52) U.S. Cl. ..... 362/217; 362/223; 362/225
(58) Field of Search ..... 362/217, 223, 362/255

(56) References Cited

U.S. PATENT DOCUMENTS

| | | | |
|---|---|---|---|
| 2,277,433 A | 3/1942 | Guth | 240/106 |
| 2,366,216 A | 1/1945 | Roberts | |

(List continued on next page.)

FOREIGN PATENT DOCUMENTS

| | | |
|---|---|---|
| GB | 1014560 | 12/1965 |
| WO | WO 94/11766 | 5/1994 |
| WO | WO 95/17303 | 6/1995 |
| WO | WO 95/17691 | 6/1995 |
| WO | WO 95/17692 | 6/1995 |
| WO | WO 95/17699 | 6/1995 |
| WO | WO 95/27919 | 10/1995 |
| WO | WO 96/19347 | 6/1996 |
| WO | WO 97/01440 | 1/1997 |
| WO | WO 97/32225 | 9/1997 |
| WO | WO 99/36262 | 7/1999 |
| WO | WO 99/36812 | 7/1999 |
| WO | WO 99/36813 | 7/1999 |

*Primary Examiner*—Thomas M. Sember
(74) *Attorney, Agent, or Firm*—George W. Jonas

(57) ABSTRACT

A light tube for use over a light element, wherein the light tube comprises an elongated, generally tubular body having a first end, a second end, a length between the first and second ends, and a longitudinal axis extending from the first end to the second end, a longitudinal slot extending generally parallel to the longitudinal axis from the first end to the second end of the body, the slot having a first side and a second side, and at least a first notch adjacent the longitudinal slot, wherein the first notch extends from the first end of the body toward the second end of the body on one of the sides of the longitudinal slot. The light tube may further comprise a second notch adjacent the longitudinal slot, wherein the second notch extends from the first end of the body toward the second end of the body on the other side of the longitudinal slot.

28 Claims, 3 Drawing Sheets

U.S. PATENT DOCUMENTS 2,551,710 A 5/1951 Slaughter ..... 250/51.11
2,820,918 A 1/1958 Aronstein ..... 313/108
3,124,639 A 3/1964 Kahn ..... 88/65
3,140,055 A 7/1964 Long
3,602,759 A 8/1971 Evans ..... 313/112
4,318,163 A 3/1982 Bryan ..... 362/359
4,418,378 A 11/1983 Johnson ..... 362/97
4,432,044 A 2/1984 Lautzenheiser ..... 362/223
4,642,741 A 2/1987 Cohn ..... 362/320
4,796,160 A 1/1989 Kahn ..... 362/19
4,991,070 A 2/1991 Stob ..... 362/223
5,036,436 A 7/1991 Rattigan et al. ..... 362/33
5,041,129 A * 8/1991 Hayhurst et al. ..... 606/232
5,075,823 A 12/1991 Chomyn ..... 362/2
5,095,415 A 3/1992 Anderson et al. ..... 362/329
5,143,438 A 9/1992 Giddens et al. ..... 362/84
5,184,881 A 2/1993 Karpen ..... 362/1
5,215,370 A * 6/1993 Kaplan ..... 362/296
5,359,498 A 10/1994 Karpen ..... 362/19
5,394,314 A * 2/1995 Evanisko ..... 362/216
5,412,902 A * 5/1995 Hicks ..... 43/4.87
5,433,024 A * 7/1995 Lerner ..... 362/31
5,440,467 A 8/1995 Lautzenheiser ..... 362/222
5,486,949 A 1/1996 Schrenk et al. ..... 359/498
5,506,704 A 4/1996 Broer et al. ..... 359/63
5,510,965 A 4/1996 Teakell ..... 362/223
5,612,820 A 3/1997 Schrenk et al. ..... 359/498
5,691,789 A 11/1997 Li et al. ..... 349/98
5,751,388 A 5/1998 Larson ..... 349/96
5,783,120 A 7/1998 Ouderkirk et al. ..... 264/1.34
5,793,456 A 8/1998 Broer et al. ..... 349/98
5,825,542 A 10/1998 Cobb, Jr. et al. ..... 359/487
5,825,543 A 10/1998 Ouderkirk et al. ..... 359/494
5,867,316 A 2/1999 Carlson et al. ..... 359/500
5,868,486 A * 2/1999 Takano et al. ..... 362/31
5,882,774 A 3/1999 Jonza et al. ..... 428/212
5,962,114 A 10/1999 Jonza et al. ..... 428/212
6,186,649 B1 * 2/2001 Zou et al. ..... 362/347

* cited by examiner

LIGHT TUBE

TECHNICAL FIELD

The present invention relates to lighting systems. More particularly, the present invention provides for a light tube that installs over conventional bulbs, such as fluorescent lamp bulbs.

BACKGROUND OF THE INVENTION

Fluorescent lighting is commonly used in commercial, office, and residential settings in a wide variety of configurations. For example, offices are often provided with multiple forms of fluorescent lighting, including overhead lighting fixtures, cabinet and shelf lighting, and task lighting. Ideally, these different types of lighting should provide efficient, comfortable, glare-free lighting to all surfaces used by office workers, particularly those surfaces where people may be reading or writing. However, it can be difficult to provide glare-free illumination from a linear light source such as a fluorescent bulb. The need to provide high-quality lighting can also be complicated by a desire to maximize the efficiency of each lighting system.

To address these concerns, various methods have been developed for modifying the light emitted by fluorescent bulbs. For example, a fluorescent light fixture may be fitted with a light reflectors or deflectors of various forms that direct the light away from the fixture itself and toward the room and work surfaces. In this way, a larger percentage of the light emitted by the bulbs can be utilized, thereby increasing the efficiency of the lamp.

Another means of modifying light emissions is through the use of light polarizers which take advantage of the fact that light may be resolved into two orthogonal components, one of which vibrates parallel to a work surface and the other of which vibrates perpendicular to a work surface. Linear light polarizers can reduce glare by only allowing a certain component of emitted light to pass through the polarizing filter to a work surface. More specifically, these light polarizers can be used to allow mainly the perpendicular vibrating component of the light to reach a work surface, which is the portion of the light that penetrates into a task and returns to the eye carrying information about the task itself (such as color, contrast, etc.). At the same time, the light polarizer can eliminate or limit the amount of the parallel polarized portion of a light that reaches a work surface, which is the portion that bounces off a task and causes the spectral or reflective glare perceived by the eye. Thus, it is often desirable to use linear polarizers, such as reflective polarizers, between the light and the work surface so that only the more desirable vertically polarized light reaches the work surface. Suitable multilayer reflective polarizers are described, for example, in U.S. Pat. Nos. 5,882,774; 5,962,114; 5,486,949; and 5,612,820, in PCT publications WO 95/27919, 95/17691, and 97/01440, and in U.S. patent application Ser. No. 09/126,917. Suitable continuous-disperse phase reflective polarizers are described, for example, in U.S. Pat. Nos. 5,825,543, 5,867,316 and 5,751,388, in PCT publications WO 97/32225 and 99/36812, and in U.S. patent application Ser. No. 09/127,314.

Fluorescent bulbs may also be provided with protective shields to protect persons from injury in the event of tube breakage. For example, the food service industry commonly uses protective shields over fluorescent bulbs in areas where glass breakage could contaminate food products. These protective shields may include a transparent or translucent rigid plastic sleeve that is slid over a fluorescent bulb before installing the bulb in a fixture. The bulb is typically sealed in the sleeve with rigid end caps through which electrical bulb contacts can protrude for installation into a fixture. While this method of installing sleeves can provide the desired protection, the installation process can be cumbersome and time-consuming since it requires that the bulb be removed from the fixture before the sleeve can be installed. However, these sleeves are not typically designed for use with polarizing films or other means of modifying light emissions from fluorescent bulbs.

Other sleeves that are not necessarily used for protection or safety may also be installed over various types of bulbs for other purposes. For example, a sleeve can be used that filters out ultraviolet light or modifies the color of output light. Sleeves of this type are typically used to keep objects upon which the light falls from fading due to exposure to ultraviolet light, or to change the mood of a room through the use of various colored lights. There is, however, a need for light sleeves or covers that can be easily installed in light fixtures without necessarily removing the light bulb from the fixture.

SUMMARY OF THE INVENTION

In one aspect of this invention a light tube is provided for use over a light element, wherein the light tube comprises an elongated, generally tubular body having a first end, a second end, a length between the first and second ends, and a longitudinal axis extending from the first end to the second end, a longitudinal slot extending generally parallel to the longitudinal axis from the first end to the second end of the body, the slot having a first side and a second side, and at least a first notch adjacent the longitudinal slot, wherein the first notch extends from the first end of the body toward the second end of the body on one of the sides of the longitudinal slot.

The present invention also includes within its scope a light tube that further comprises a second notch adjacent the longitudinal slot, wherein the second notch extends from the first end of the body toward the second end of the body on the other side of the longitudinal slot. The first notch and second notch may be symmetrical about the first and second sides of the longitudinal slot, and the first side of the slot may be spaced from the second side of the slot.

The tubular body may further comprise an interior portion and the tube may include a first flange extending from the first side of the slot toward the interior portion of the body along the length of the body to form a first channel between the body and the first flange. Similarly, the tube may further comprise a second flange extending from the second side of the slot toward the interior portion of the body along the length of the body to form a second channel between the body and the second flange. The tube may further include a film sheet having a first end and a second end, wherein the first end of the film is positioned in the first channel and the second end of the film is positioned in the second channel.

Also provided is a light system comprising a light element and a light tube at least partially surrounding the light element, wherein the light tube comprises an elongated, generally tubular body having a first end, a second end, a length between the first and second ends, and a longitudinal axis extending from the first end to the second end, a longitudinal slot extending generally parallel to the longitudinal axis from the first end to the second end of the body, the slot having a first side and a second side, and at least a first notch adjacent the longitudinal slot, wherein the first notch extends from the first end of the body toward the second end of the body on one of the sides of the longitudinal slot.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
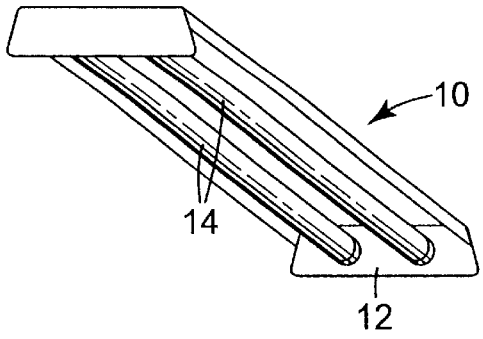
FIG. 1 is a perspective view of a standard fluorescent lamp light fixture.

Referring now to the Figures, and initially to FIG. 1, a light fixture 10 for fluorescent lighting is illustrated, which basic components comprise a housing 12 and two fluorescent lamps 14. The light fixture 10 may optionally be provided with a transparent or translucent cover (not shown) that fits over the housing 12. Such a cover can act to keep dust or contaminants from reaching the light fixture, to modify the light emitted from the fluorescent tubes, and to provide a more pleasing aesthetic appearance to the fixture. However, a cover is not necessary and is often omitted from a light fixture in order to allow easy access to the fluorescent lamps and to maximize the amount of light that reaches the room.

Figure 2:
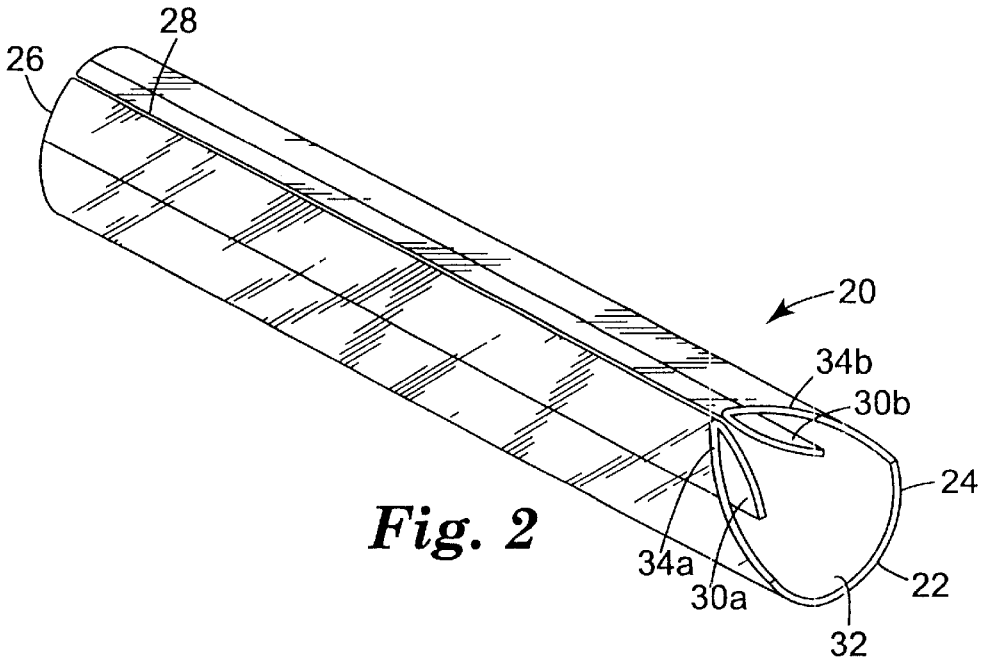
FIG. 2 is a perspective view of a light tube in accordance with the present invention.

FIG. 2 illustrates one preferred embodiment of a light sleeve or tube 20 in accordance with the present invention, where tube 20 is adapted to be installed over a conventional cylindrical light bulb, such as a fluorescent lamp of the type shown in FIG. 1. In this embodiment, light tube 20 generally comprises a body portion 22 having a first end 24, a second end 26, a slot 28 extending along body portion 22 from first end 24 to second end 26, and tabs or flanges 30*a*, 30*b* projecting inwardly from slot 28 toward an interior area 32 of body portion 22. The light tube 20 further includes a first angled edge 34*a* extending from first end 24 toward second end 26 on one side of slot 28, and a second angled edge 34*b* extending from first end 24 toward second end 26 on the opposite side of slot 28. These angled edges 34*a*, 34*b* essentially form notches cut out of body portion 22 on opposite sides of slot 28.

Figure 3:
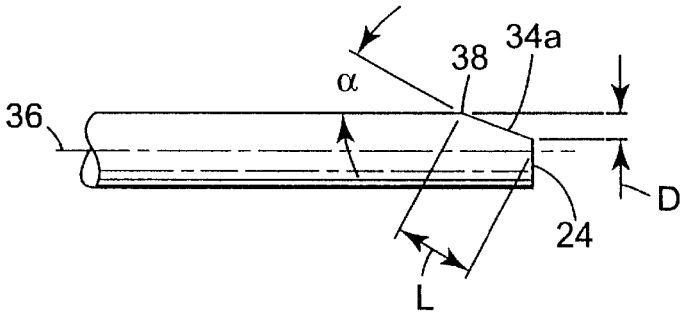
FIG. 3 is a side view of a light tube of the type illustrated in FIG. 2.

FIG. 3 shows another view of a preferred light tube embodiment of the present invention. In this view, angled edge 34*a* extends from first end 24 to an apex 38. Angled edge 34*a* also has a length L, a cut depth D, and forms an angle $\alpha$ with respect to a centerline 36 of body portion 22. The angle $\alpha$ is also referred to as the "cut angle" with respect to the centerline 36. Although the opposite side of light tube 20 cannot be seen from this view, this embodiment of light tube 22 is generally symmetrical about the slot 28. Thus, second edge 34*b* similarly extends from first end 24 to apex 38, has the same length as the length L of edge 34*a*, and forms an angle that is generally the same as the angle a with respect to centerline 36.

Figure 4:
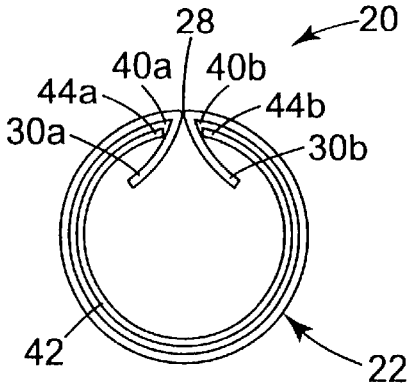
FIG. 4 is a cross-sectional view of a light tube.

As is best shown in FIGS. 2 and 4, Flanges 30*a*, 30*b* preferably extend from opposite sides of slot 28 toward the interior area 32 of body portion 22 in a hook-like fashion. Flanges 30*a*, 30*b* preferably extend longitudinally along the length of the tube 20 from apex 38 to second end 26. In this way, channels 40*a*, 40*b* are formed as the area between the body portion 22 and the flanges 30*a*, 30*b*, respectively, along the length of the tube. A sheet of film 42 may be inserted within the tube 20 and held in place by channels 40*a*, 40*b*. The film sheet 42 can be installed in the tube 20 by partially bending or curling the sheet 42 into an arc-like shape and inserting it into either the first end 24 or the second end 26 of the tube 20 so that one end 44*a* of film sheet 42 rests in channel 40*a*, while the other end 44*b* of film sheet 42 rests in channel 40*b*. The width of film 42 between the two film ends 44*a*, 44*b* generally follows the curvilinear shape of the body portion 22.

Film sheet 42 is typically used to vary some characteristic of the light emitted from a lamp before it reaches the user. For example, film sheet 42 may be designed to filter or soften the light emitted from a lamp, or may be tinted to change the color of the light that reaches the room. For another example, the film 42 may be an IR filter that transmits visible light but reflects infrared radiation back into the light source. For yet another example, the film 42 may be a polarization film that polarizes the light emitted from a fluorescent lamp, which reduces glare from the lamp and thereby helps to reduce eye fatigue and facilitates comfortable reading. The polarization film may be an absorptive polarizer, which transmits light of one polarization state and absorbs light of a different polarization state, but preferably the polarization film is a reflective polarizer which allows recycling of light. Any useful reflective polarizer elements may be used that transmit light of any desired polarization. Typically, the reflective polarizing elements transmit light of one polarization state and reflect light of a different polarization state. The materials and structures used to accomplish these functions can vary. Depending on the materials and structure of the optical film, the term "polarization state" can refer to, for example, linear, circular, and elliptical polarization states.

Examples of suitable reflective polarizing elements include multilayer reflective polarizers, continuous/disperse phase reflective polarizers, cholesteric reflective polarizers (which are optionally combined with a quarter wave plate), and wire grid polarizers. In general, multilayer reflective polarizers and cholesteric reflective polarizers are specular reflectors and continuous/disperse phase reflective polarizers are diffuse reflectors, although these characterizations are not universal (see, e.g., the diffuse multilayer reflective polarizers described in U.S. Pat. No. 5,867,316). This list of illustrative reflective polarizing elements is not meant to be an exhaustive list of suitable reflective polarizing elements. Any reflective polarizer that preferentially transmits light having one polarization and preferentially reflects light having a second polarization can be used.

Both multilayer reflective polarizers and continuous/disperse phase reflective polarizers rely on index of refraction differences between at least two different materials to selectively reflect light of one polarization orientation while transmitting light with an orthogonal polarization orientation. Suitable diffuse reflective polarizers include the continuous/disperse phase reflective polarizers described in U.S. Pat. Nos. 5,825,543 and 5,783,120, as well as the diffusely reflecting multilayer polarizers described in U.S. Pat. No. 5,867,316. Other suitable diffuse reflective polarizers are described in U.S. Pat. No. 5,751,388. One commercially available form of a diffuse reflective polarizer is marketed as Diffuse Reflective Polarizer Film (DRPF) by the Minnesota Mining and Manufacturing Company of St. Paul, Minn.

Cholesteric reflective polarizers are described in U.S. Pat. Nos. 5,793,456, 5,506,704, and 5,691,789, for example. One exemplary cholesteric reflective polarizer is marketed under the trade designation "TRANSMAX" by E. Merck & Co. Wire grid polarizers are described in, for example, PCT Publication WO 94/11766.

Illustrative multilayer reflective polarizers are described in, for example, PCT Publication Nos. WO95/17303; WO95/17692; WO95/17699; WO96/19347; and WO99/36262, and U.S. patent application Ser. No. 09/399,531. Other reflective multilayer polarizers are described, for example, in U.S. Pat. Nos. 5,486,949, 5,612,820, and 5,882,774. One commercially available form of a multilayer reflective polarizer is marketed as Dual Brightness Enhanced Film (DBEF) by the Minnesota Mining and Manufacturing Company of St. Paul, Minn.

Reflective polarizers are used herein as an example to illustrate optical film structures and methods of making and using the optical films that can be useful in the invention. The structures, methods, and techniques described herein can be adapted and applied to other types of optical films. The reflective polarizers or other optical films may include additional layers or coatings to tailor the optical properties of the film for desired end uses. For example, the reflective polarizer may include an absorptive polarizer layer, such as a dichroic polarizer layer, as described in WO95/17691 and WO99/36813. Additionally, the reflective polarizer may include a diffusing layer as described in U.S. Pat. No. 5,825,542 and U.S. patent application Ser. No. 09/399,531. Other suitable layers and coatings are described in WO97/01440, the contents of which are herein incorporated by reference.

In one embodiment, the film sheet 42 can be a reflective polarizer sheet positioned to vary the characteristics of light emitted from a lamp around the entire circumference of the lamp. Alternatively, the film sheet 42 may be positioned to only vary the characteristics of light emitted from the front or output side of the lamp, and a reflector may be applied to the back side of the lamp. The reflector may be a specular reflector or a diffuse reflector and may be constructed of any suitable specular or diffuse reflective material. Specular reflective materials advantageously include a metallized coating, a mirror coating, a metallized film, a multilayer mirror film, a metallized paint and metallized tape. Also useful are foils comprising metals like silver, aluminum, nickel and other known metals and alloys. Diffuse reflective materials also include a diffuse-coated reflective multilayer mirror film, white paint, micro-voided films, multi-phase films and equivalent diffuse reflective materials. The reflector it may be present as a separate partial sheet within the light tube 20, a combined film sheet 42 within the light tube 20, wherein a portion of the sheet is a mirror and portion is, for example, a polarizer, or a reflective mirror film may be applied directly to either the interior or exterior back surface of the light tube 20, for example, by vapor or sputter coating, painting, or adhesive lamination. Examples of combinations of mirror films and polarizer films suitable for creating polarized light sources are described, for example, in WO95/27919, incorporated herein by reference.

Film sheet 42 is preferably long enough that it extends substantially the entire length of the channels 40*a*, 40*b*. However, the sheet may instead be longer than the channels 40*a*, 40*b* such that the film would extend beyond at least one of the tube ends. Alternatively, the sheet could be shorter than the length of the channels 40*a*, 40*b*. In any case, if the film sheet 42 is long enough to extend into the area of the angled edges 34*a* and 34*b*, it is preferable that the film sheet 42 have edges that are angled similarly to the angled edges 34*a* and 34*b* of the tube in which the film sheet is installed. For proper installation of film sheet 42 within body portion 22, the sheet should also be at least wide enough that it can securely fit within the channels 40*a*, 40*b* without slipping out.

Figure 9:
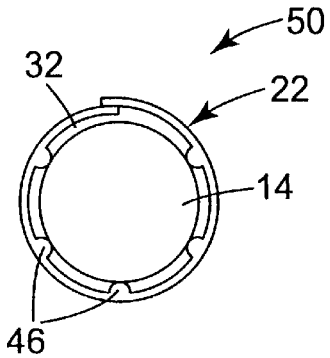
FIG. 9 is a cross-sectional view of another embodiment of a light tube in accordance with the present invention.

An alternative embodiment of the present invention is a light tube that can alter the characteristics of emitted light without the use of an additional film sheet. In this embodiment, the body portion itself could be made out of a polarizing film, for example, so that no additional film sheet may be required. It may also be desirable for a light tube 50 to have multiple projections 46 formed on the inside of body portion 22 and extending toward the interior area 32 of the light tube, as shown in FIG. 9. As shown, these projections 46 are useful to keep the light tube spaced from lamp 14. Projections 46 may be provided in many forms, such as small raised bumps that are embossed into the material of which the light tube is formed, raised strips along the length or width of the light tube, partially cut-out tube portions that are folded toward the interior of the tube, or the like. The projections may be in a random arrangement or may have some more definite pattern. Further, the projections may also be made of the same or different material than the light tube and may be integrally molded into the body portion or may be separate components that are attached to the body portion by another process such as adhesion, welding, or other attachment method.

Even when the body portion itself is made of a material that modifies certain properties of the emitted light, an additional film sheet may be used to modify additional properties of that light. For example, the body portion may be made of polarizing film and a colored sheet may be inserted therein.

Figure 5:
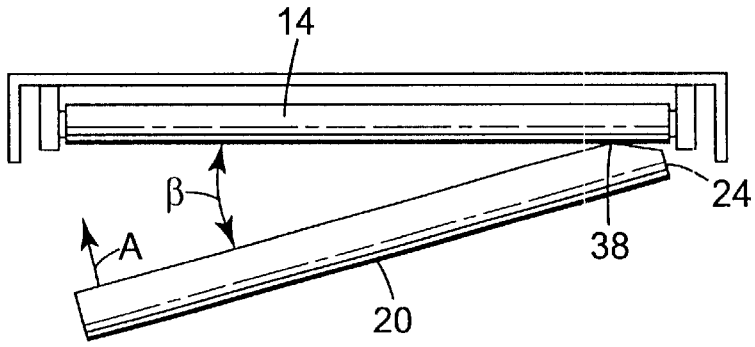
FIG. 5 is a first schematic view of a light tube being installed over a fluorescent lamp.
Figure 6:
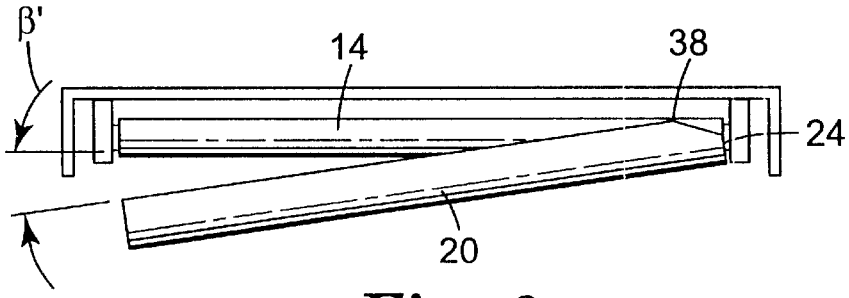
FIG. 6 is a second schematic view of a light tube being installed over a fluorescent lamp.
Figure 7:
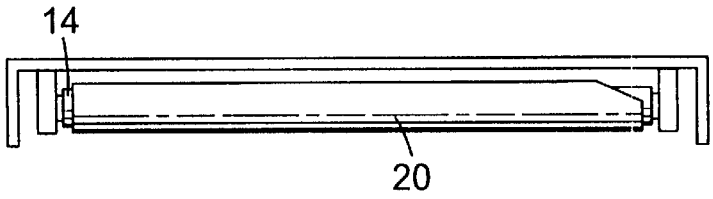
FIG. 7 is a schematic view of a light tube installed over a fluorescent lamp.

FIGS. 5 through 7 sequentially illustrate installation of a light tube 20 onto a light fixture having a fluorescent lamp 14. Lamp 14 may be part of any of a number of types of light fixtures, such as a conventional light fixture generally of the type shown in FIG. 1, a portable or permanently installed desktop light fixture, or the like. First, light tube 20 is held at an installation angle β relative to fluorescent lamp 14 with the first end 24 of tube 20 closest to the lamp 14. Light tube 20 is moved up toward lamp 14 until the area near apex 38 comes into contact with lamp 14. Light tube 20 is then pushed generally upward in direction A with enough force to cause the slot to start separating or opening in the area of apex 38. Tube 20 continues to be pushed upward so that the slot 28 separates further and causes tube 20 to surround the outside of lamp 14 on its bottom side. Tube 20 continues to be pushed upward at a decreasing angle β' (as shown in FIG. 6) so that the tube 20 separates along more of the tube length from apex 38 toward second end 26. It is noted that when the tube 20 continues to be pushed upward, the area of the tube nearest the apex 38 continues to surround more of the lamp 14. While the upward pushing motion causes tube 20 to be separated or opened along the entire length of slot 28, tube 20 continues to be pushed upward until the tube generally surrounds lamp 14 along its entire length, as shown in FIG. 7. At this point, tube 20 is considered to be installed on the lamp 14.

It has been found that the amount of force to push a tube of this type onto a lamp decreases once the apex or any other portion of the slot has passed the centerline of the lamp 14. This occurs because the apex or slot of a light tube of the type described encounters the widest diameter of the lamp at the lamp's centerline, thus, the tube actually starts to close as it passes this point, which helps to pull or urge the rest of the tube onto the lamp.

As the tube reaches the point where its entire length generally surrounds the lamp, the tube preferably returns to the original shape it held before being pushed onto the lamp, where the two sides of slot are adjacent or touching each other. Thus, the tube is preferably made of a material that is sufficiently rigid to maintain its shape throughout the installation process, yet sufficiently elastic to allow the tube to deform temporarily then return to its general original shape without significant permanent deformation of the tube material. In this way, a tube will not be damaged through the course of multiple installations and removals. One preferred material for the tube is a polycarbonate material preferably having a thickness in the range of 0.13 mm to 0.76 mm, but more preferably has a thickness in the range of 0.25 mm to 0.38 mm. It is also preferred that the tube material have a glass transition temperature higher than the highest temperature that the bulb surface reaches after extended use. It is understood that the tube material itself may or may not change the characteristics of the emitted light, as desired.

A light tube can typically be more easily installed on a lamp when the apex 38 has actually begun to open slightly before it actually comes in contact with the lamp. For this to occur, the installation angle $\beta$ is preferably selected so that at least one of the angled edges comes in contact with the lamp before the lamp contacts the apex. The selected installation angle $\beta$ also depends on several other factors, such as the diameter of the lamp, the length and angle of the angled edges, the cut angle $\alpha$ of the tube relative to its centerline, and the cut depth D. More specifically, the preferred cut depth D for a tube 20 depends on the dimensions of the lamp on which it will be installed, and for efficient installation is preferably selected to be less than the radius of the lamp. In addition, the installation angle $\beta$ is preferably slightly greater than the cut angle $\alpha$. However, in circumstances where the lamp is located near a surface, such as a desktop, the selection of the installation angle $\beta$ may be limited by interference between the tube and the desktop.

A particular light tube should be selected for each particular installation depending on the diameter and length of the lamp. That is, in order to completely surround a lamp along its entire length, the light tube should be at least as long as the lamp, but not so long as to interfere with the fixture in which the lamp is mounted. In addition, the light tube should be large enough in diameter to be able to return to its relaxed state after installation on a lamp, but is preferably not so large that the light tube interferes with the fixture and that a significant space exists between the light tube and the lamp when installed.

Although some flange embodiments have been described above, it is understood that various other configurations of the flanges can be equally suitable to hold a film sheet within a light tube. For example, the flanges can be longer or shorter than the illustrated flanges. Flanges 30*a*, 30*b* can be relatively planar, as shown, or may be provided in a curved or other alternative geometry. In addition, the flanges can be positioned at different angles and distances from the body portion so that the channels are either wider or more narrow, as desired. In any case, it is desirable to design the channels to adequately hold a film sheet in place within a light tube, yet allow for easy insertion and removal of the film within the tube. Further, the flanges may be integrally molded into the body portion, or may be separate components that are attached to the body portion by a separate process such as adhesion, welding, or other attachment method.

Flanges 30*a*, 30*b* also provide some rigidity to the tube 20 in the area of slot 28 that can minimize crushing of the tube during the installation process. However, the light tube 20 may only have a flange on one side of the slot 28, or may not have any flanges. If no flanges are provided, a film sheet 42 may still be inserted within the tube 20 if desired. In this case, the film sheet 42 can be curved to fit the general interior shape of the tube and inserted therein. This sheet 42 preferably should have enough rigidity that it does not have a tendency to curl up on itself so that it does not interfere with installation of the light tube onto a lamp. The film 42 may also be fastened to the interior or exterior of the tube 20 by techniques such as adhesion, sonic welding, mechanical punching, or the like.

The flanges 30*a*, 30*b* may also be designed so that they are long enough to touch the outside of the lamp on which the tube is installed. This contact between the flanges and the lamp can prevent or minimize movement or spinning of the light tube relative to the lamp, which may occur in environments that are particularly susceptible to vibration. Thus, the user can select the position of the slot relative to their viewing area of the lamp, for example, without concern over whether the light tube will move or spin.

Figure 10:
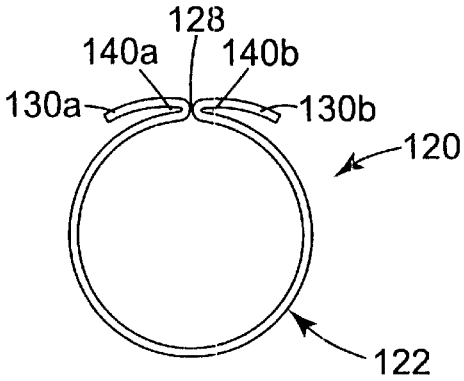
FIG. 10 is a cross-sectional view of another embodiment of a light tube in accordance with the present invention.

In an alternative embodiment shown in FIG. 10, a light tube 120 may have flanges 130*a*, 130*b* that extend from opposite sides of a slot 128 toward the exterior of a body portion 122 in a hook-like fashion so that channels 140*a*, 140*b* are formed as the area between the exterior surface of the body portion 122 and the flanges 130*a*, 130*b*, respectively, along the length of the tube. In this embodiment, a film sheet (not shown) may be positioned so that one end of the film sheet rests in one channel, the other end of the film sheet rests in the other channel, and the width of the film sheet generally follows the curvilinear shape of the exterior of the body portion. The variations in the flanges 130*a*, 130*b* and attachment methods described above with regard to flanges extending into the interior portion of the light tube also apply to this embodiment where the flanges are on the exterior of the tube. For example, the flanges may be integrally molded into the body portion or may be separate components that are attached to the body portion by a separate process.

Again, while the flanges provide some rigidity to the tube in the area of the slot, the light tube may only have a flange on one side of the slot or may not have any flanges. If no flanges are provided, a film sheet may instead be curved to generally match the shape of the exterior of the tube and fastened to the tube by techniques such as adhesion, sonic welding, mechanical punching, or the like.

It is also in accordance with the present invention that the light tube 20 may instead be asymmetrical about the slot 28, such that the cut angle $\alpha$ on one side of the slot is different than the angle $\alpha'$ and the length L of edge 34*a* is different from the length of edge 34*b*. In this case, edges 34*a*, 34*b* may not actually meet each other at an apex. Rather, edges 34*a*, 34*b* would each end at slot 28, but at different distances from the end 24 of body portion 22. This may occur either by design or through the manufacturing process. In either case, it is preferable that edges 34*a*, 34*b* end as close to each other as possible with respect to their distances from end 24 so that they form a sort of point or apex that is useful in the installation process.

Tube 20 has been described as being generally cylindrical in shape, however, it is understood that any other shape that could fit over a lamp, such as a fluorescent lamp, would be acceptable, such as an ellipse, oval, irregular shape, or the like. In fact, it can be advantageous in some applications for the body portion of the light tube to be slightly elliptical to help prevent the light tube from spinning relative to a generally cylindrical fluorescent lamp over which it is installed. Of course, if the fluorescent or other type of lamp has a shape that is not cylindrical, the light tube 20 can be designed to have a shape that is consistent with that of the lamp so that the tube 20 adequately fits the shape of the lamp.

The light tube is preferably designed so that the two sides of the slot touch each other when the tube is in its relaxed state, however, there may be a gap between the sides of slot 28 when the tube 20 is in its relaxed state. This gap is preferably relatively small so that most of the circumference of the lamp on which the tube is installed will be surrounded by the tube. However, this gap can also be larger, but must be small enough that the light tube will not fall off the lamp on which it is installed. In other words, the gap should be smaller than the diameter of the lamp on which it is installed. It is further within the scope of the invention that the two sides of the longitudinal split in the tube actually overlap each other when the light tube is in its relaxed state.

Each light tube may be provided with angled edges 34*a*, 34*b* extending only from first end 24 toward second end 26, or may also include angled edges extending from second end 26 toward first end 24. If the light tube includes such angled edges at both ends of the tube, the edges may have the same or different angles at each end.

Various manufacturing methods may be used to produce the light tubes of the present invention. One preferred manufacturing method is to extrude lengths of tubing with the desired profile (including a longitudinal slot and flanges), then cut the tubing to the desired length for each individual light tube. If it is desired to use a film sheet, the sheet could then be inserted by hand or through some type of automated process. Angled edges may then be cut on opposite sides of the slot by either opening the tube and pressing it generally flat before cutting, or the angled edges could be cut after the tube is slid over a mandrel.

Alternatively, a tube could be extruded as a complete cylinder, without a longitudinal slot and/or flanges. In these situations, the tube would be cut longitudinally to make a slot along the length of the tube. If flanges were already extruded into the tube profile, no further steps may be necessary. However, if the tube does not yet include flanges, they may be either formed along the longitudinal slot by folding the edges of the slot toward the interior of the tube or by some other forming method, or flanges could be attached by a separate process, such as adhesion or welding, for example. In some cases, the sides of the tube on opposite sides of the slot may overlap each other when the tube is in its relaxed state. If desired, this condition may be eliminated by annealing the tube.

In another alternative manufacturing process, each tube could be formed from a generally flat sheet of material. This sheet may be cut to the desired length and may have the desired angled edges cut therefrom. The sheet would then be formed into a generally cylindrical shape by cold forming or some type of annealing process. The forming process could take place with or without a film sheet positioned so that it would be inside the tube when it is formed. As previously described, it is also contemplated that any desired light-altering properties of the finished tube may alternatively be included within the tube material itself so that a separate film sheet is not required. This may also be accomplished by coating a light-altering material onto the tube material.

The operation of the present invention will be further described with regard to the following detailed examples. These examples are offered to further illustrate the various specific and preferred embodiments and techniques. It should be understood, however, that many variations and modifications may be made while remaining within the scope of the present invention.

THE EXAMPLES

Figure 8:
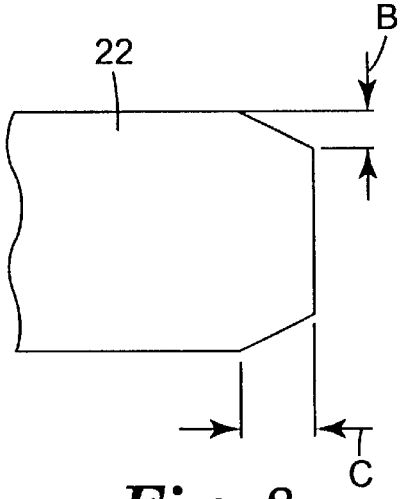
FIG. 8 is a top view of a portion of a flattened light tube in accordance with the invention.

For purposes of describing the dimensional relationships between the parts of the light tube relative to a lamp on which it can be installed, an extruded polycarbonate tube with a material thickness of 0.51 mm was cut along its longitudinal axis to create a split tube. The tube was then annealed by placing it around the outside of a copper tube, heating it in an oven and removing it to cool at room temperature. This heating and cooling cycle created a split tube with a diameter of 40.6 mm and having the edges of the tube on opposite sides of the slot generally meeting each other along the length of the tube. This split tube was then flattened against a cutting surface, as generally shown in FIG. 8. Cuts or notches of various dimensions B and C were then cut or removed from the flattened tube. The flattened tube was then released to allow it to return to its tubular shape. This general technique was used to create each of the various light tube notch designs that were tested.

A first set of light tubes was tested, with each tube having a 40.6 mm tube diameter and differing notch dimensions B and C. Each light tube was pushed onto a fluorescent lamp having a 38.1 mm diameter in the manner described above for installation of light tubes. The smallest angle at which the tube could be easily installed onto the lamp without crushing the tube was then measured, with the results as follows in Table 1:

TABLE 1

| Sample No. | Tube Diameter (mm) | Lamp Diameter (mm) | B (mm) | C (mm) | Smallest installation angle |
|---|---|---|---|---|---|
| 1 | 40.6 | 38.1 | 6.35 | 63.5 | 45 |
| 2 | 40.6 | 38.1 | 6.35 | 44.5 | 40 |
| 3 | 40.6 | 38.1 | 6.35 | 25.4 | None |
| 4 | 40.6 | 38.1 | 7.87 | 63.5 | 10 |
| 5 | 40.6 | 38.1 | 7.87 | 44.5 | 15 |
| 6 | 40.6 | 38.1 | 7.87 | 25.4 | 20 |
| 7 | 40.6 | 38.1 | 9.65 | 63.5 | 15 |
| 8 | 40.6 | 38.1 | 9.65 | 44.5 | 25 |
| 9 | 40.6 | 38.1 | 9.65 | 25.4 | 30 |
| 10 | 40.6 | 38.1 | 12.70 | 63.5 | 20 |
| 11 | 40.6 | 38.1 | 12.70 | 44.5 | 30 |
| 12 | 40.6 | 38.1 | 12.70 | 25.4 | 35 |
| 13 | 40.6 | 38.1 | 19.05 | 63.5 | 25 |
| 14 | 40.6 | 38.1 | 19.05 | 44.5 | 35 |
| 15 | 40.6 | 38.1 | 19.05 | 25.4 | 45 |

A second set of light tubes was tested, with each tube having a 27.9 mm tube diameter and differing notch dimensions B and C. Each light tube was pushed onto a fluorescent lamp having a 25.4 mm diameter in the manner described above for installation of light tubes. The smallest angle at which the tube could be easily installed onto the lamp without crushing the tube was then measured, with the results as follows in Table 2:

TABLE 2

| | Tube Diameter (mm) | Lamp Diameter (mm) | B (mm) | C (mm) | Smallest installation angle |
|---|---|---|---|---|---|
| 1 | 27.9 | 25.4 | 3.96 | 42.06 | 35 |
| 2 | 27.9 | 25.4 | 3.96 | 29.36 | 40 |
| 3 | 27.9 | 25.4 | 3.96 | 15.87 | 55 |
| 4 | 27.9 | 25.4 | 5.16 | 42.06 | 10 |
| 5 | 27.9 | 25.4 | 5.16 | 29.36 | 20 |
| 6 | 27.9 | 25.4 | 5.16 | 15.87 | 30 |
| 7 | 27.9 | 25.4 | 6.35 | 42.06 | 10 |
| 8 | 27.9 | 25.4 | 6.35 | 29.36 | 15 |
| 9 | 27.9 | 25.4 | 6.35 | 15.87 | 20 |
| 10 | 27.9 | 25.4 | 10.31 | 42.06 | 10 |
| 11 | 27.9 | 25.4 | 10.31 | 29.36 | 20 |
| 12 | 27.9 | 25.4 | 10.31 | 15.87 | 30 |
| 13 | 27.9 | 25.4 | 12.70 | 42.06 | 15 |
| 14 | 27.9 | 25.4 | 12.70 | 29.36 | 20 |
| 15 | 27.9 | 25.4 | 12.70 | 15.87 | 25 |

The Examples demonstrate that the smallest angle at which a particular light tube can be installed varies depending on the dimensions of the notch and the diameter of the lamp. Typically, it is desirable to select a light tube with a smaller minimum installation angle since this provides a wider range of possible installation angles. In other words, a light tube having a minimum installation angle of 10 degrees would provide a light tube installer with more options than a light tube having a minimum installation angle of 55 degrees.

As described above, the light tube of the present invention can be easily installed over a fluorescent lamp without having to disassemble or reconfigure the light fixture itself. This provides for quick, safe installation of light tubes without extra tools or equipment. Further, the light tube is easily removable and can be reused multiple times on the same or different lamps.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

We claim:

1. A light tube for use over a longitudinal light element, the light tube comprising:

an elongated, generally tubular body having a first end, a second end, a length between the first and second ends, and a longitudinal axis extending from the first end to the second end;

a longitudinal slot extending generally parallel to the longitudinal axis from the first end to the second end of the body, the slot having a first side edge and a second side edge, wherein the tubular body is disposable about the longitudinal light element such that the tubular body is retained over the longitudinal light element due to the contact between the tubular body and the longitudinal light element; and at least a first notch adjacent the longitudinal slot, wherein the first notch comprises an angled edge of one of the first and second side edges of the longitudinal slot that is angled from the first end of the body toward the second end of the body.

2. The light tube of claim 1, further comprising a second notch adjacent the longitudinal slot, wherein the second notch comprises an angled edge of the other of the first and second side edges of the longitudinal slot that extends from the first end of the body toward the second end of the body.

3. The light tube of claim 2, wherein the first notch and second notch are symmetrical about the first and second side edges of the longitudinal slot.

4. The light tube of claim 1, wherein the first side edge of the slot is spaced from the second side edge of the slot.

5. The light tube of claim 1, wherein the tubular body further comprises an interior portion and a first flange extending from the first side edge of the slot toward the interior portion of the body along the length of the body to form a first channel between the body and the first flange.

6. The light tube of claim 5, wherein the tubular body further comprises a second flange extending from the second side edge of the slot toward the interior portion of the body along the length of the body to form a second channel between the body and the second flange.

7. The light tube of claim 1, wherein the tubular body further comprises an interior surface inside the body and wherein the tube further comprises a film sheet adjacent the interior surface of the body.

8. The light tube of claim 7, wherein the film sheet is attached to the interior surface of the body.

9. The light tube of claim 7, wherein the film sheet is adhered to the interior surface of the body.

10. The light tube of claim 1, wherein the tubular body further comprises an exterior body surface and wherein the tube further comprises a film sheet adjacent the exterior surface of the body.

11. The light tube of claim 10, wherein the film sheet is attached to the exterior surface of the body.

12. The light tube of claim 10, wherein the film sheet is adhered to the exterior surface of the body.

13. The light tube of claim 1, wherein the tubular body further comprises an interior portion and an exterior surface and wherein the tube further comprises a first flange extending from the first side edge of the slot away from the interior portion of the body and spaced from the exterior surface along the length of the body to form a first channel between the body and the first flange.

14. The light tube of claim 13, further comprising a second flange extending from the second side edge of the slot away from the interior portion of the body and spaced from the exterior surface along the length of the body to form a second channel between the body and the second flange.

15. The light tube of claim 14, further comprising a film sheet having a first end and a second end, wherein the first end of the film is positioned in the first channel and the second end of the film is positioned in the second channel.

16. The light tube of claim 1, wherein the body comprises a light-altering material.

17. The light tube of claim 1, further comprising a light-altering coating on the tubular body.

18. The light tube of claim 1, wherein the tubular body further comprises an interior portion and wherein the tube further comprises at least one projecting member extending from the interior body surface.

19. A light tube for use over a light element, the light tube comprising:

an elongated, generally tubular body having a first end, a second end, a length between the first and second ends, and a longitudinal axis extending from the first end to the second end;

a longitudinal slot extending generally parallel to the longitudinal axis from the first end to the second end of the body, the slot having a first side and a second side; and at least a first notch adjacent the longitudinal slot, wherein the first notch extends from the first end of the body toward the second end of the body on one of the first and second sides of the longitudinal slot, wherein the tubular body further comprises an interior portion and a first flange extending from the first side of the slot toward the interior portion of the body along the length of the body to form a first channel between the body and the first flange, a second flange extending from the second side of the slot toward the interior portion of the body along the length of the body to form a second channel between the body and the second flange, and a film sheet having a first end and a second end, wherein the first end of the film is positioned in the first channel and the second end of the film is positioned in the second channel.

20. The light tube of claim 19, wherein the film sheet is a polarization film.

21. The light tube of claim 20, wherein the polarization film comprises multiple layers.

22. The light tube of claim 19, wherein the film sheet is a tinted film.

23. The light tube of claim 19, wherein the film sheet is a colored film.

24. A light system comprising:

a light element; and a light tube at least partially surrounding the light element, wherein the light tube is retained over the longitudinal light element due to the contact between the light tube and the light element, the light tube comprising:

an elongated, generally tubular body having a first end, a second end, a length between the first and second ends, and a longitudinal axis extending from the first end to the second end;

a longitudinal slot extending generally parallel to the longitudinal axis from the first end to the second end of the body, the slot having a first side edge and a second side edge; and at least a first notch adjacent the longitudinal slot, wherein the first notch comprises an angled edge of one of the first and second side edges of the longitudinal slot that is angled from the first end of the body toward the second end of the body.

25. The light system of claim 24, wherein the tubular body further comprises an interior portion, an exterior portion, and a first flange extending from the first side edge of the slot toward one of the interior and exterior portions of the body along the length of the body to form a first channel between the body and the first flange.

26. The light system of claim 25, wherein the tubular body further comprises a second flange extending from the second side edge of the slot toward one of the interior and exterior portions of the body along the length of the body to form a second channel between the body and the second flange.

27. A method of providing an improved light tube, comprising:

forming a notch in the light tube, wherein the notch comprises a side edge at an end of the tube that is angled with respect to a central longitudinal axis of the light tube;

disposing the notch of the light tube against a light element at an installation angle;

pushing the light tube against the light element such that a slot in the light tube starts separating; and causing the light tube to at least partially surround the light element such that the light tube is retained over the light element due to contact between the tubular body and the light element.

28. A light tube for use over a light element, the light tube comprising:

an elongated, generally tubular body having a first end, a second end, a length between the first and second ends, and a longitudinal axis from the first end to the second end of the body, the slot having a first side edge and a second side edge;

at least a first notch adjacent the longitudinal slot, wherein the first notch comprises an angled edge of one of the first and second side edges of the longitudinal slot that is angled from the first end of the body toward the second end of the body; and wherein the tubular body has an interior portion and a first flange extending from the first side edge of the slot toward the interior portion of the body along the length of the body to form a first channel between the body and the first flange.

* * * * *